US006537058B1

(12) United States Patent
Evans et al.

(10) Patent No.: US 6,537,058 B1
(45) Date of Patent: Mar. 25, 2003

(54) GAS APPLIANCES

(76) Inventors: Peter Evans, 300 Walmley Road, Sutton Coldfield, West Midlands, B76 2PL (GB); Philip Horrobin, 42 Lilac Avenue, Streetly, Sutton Coldfield, West Midlands, B74 3TF (GB)

( * ) Notice: Subject to any disclaimer, the term of this patent is extended or adjusted under 35 U.S.C. 154(b) by 0 days.

(21) Appl. No.: 09/533,911

(22) Filed: Mar. 23, 2000

(30) Foreign Application Priority Data

| | | |
|---|---|---|
| Mar. 23, 1999 | (GB) | 9906545 |
| Jul. 19, 1999 | (GB) | 9916741 |
| Jun. 2, 1999 | (GB) | 9912827 |

(51) Int. Cl.[7] ..... F24C 3/00

(52) U.S. Cl. ..... 431/1; 126/512; 137/624.15; 431/125

(58) Field of Search ..... 431/1, 125; 126/512; 137/624.15; 251/129.08, 129.05

(56) References Cited

U.S. PATENT DOCUMENTS

| | | | | |
|---|---|---|---|---|
| 1,342,160 A | * | 6/1920 | Dalén | 431/1 |
| 3,723,046 A | | 3/1973 | Poling et al. | |
| 4,085,921 A | * | 4/1978 | Ueda et al. | 251/129.08 |
| 4,930,490 A | | 6/1990 | Allan | |
| 5,746,588 A | * | 5/1998 | Binzer | 126/512 |
| 5,819,725 A | * | 10/1998 | Borgeson | 126/512 |
| 5,890,485 A | * | 4/1999 | Shimek et al. | 126/512 |
| 5,938,421 A | * | 8/1999 | George, II | 431/1 |
| 5,984,662 A | * | 11/1999 | Barudi et al. | 126/512 |

FOREIGN PATENT DOCUMENTS

| | | |
|---|---|---|
| EP | 0 532 453 A1 | 3/1993 |
| GB | 1100421 | 1/1968 |
| GB | 1378027 | 12/1974 |
| GB | 1 537 239 | 12/1978 |
| GB | 2022241 | 12/1979 |
| GB | 2134641 | 8/1984 |
| GB | 2 147 995 A | 5/1985 |
| GB | 2156968 | 10/1985 |
| GB | 2231397 | 11/1990 |
| GB | 2260806 | 4/1993 |
| GB | 2306001 | 4/1997 |
| GB | 2345956 | 7/2000 |
| WO | WO 87/07549 | 12/1987 |
| WO | WO99/27300 | 6/1999 |

OTHER PUBLICATIONS

Search Report for application No. GB 0007077.1. Date of Search is Nov. 23, 2001.

European Search Report of Feb. 28, 2002 for Application No. 00302387.6–2301.

* cited by examiner

*Primary Examiner*—Sara Clarke
(74) *Attorney, Agent, or Firm*—Barnes & Thornburg

(57) ABSTRACT

A gas appliance such as a gas burner or gas fire, has means to vary the factors producing flames in the appliance in a substantially random or pseudo-random manner. This means can take several forms, including a 'liquid-bubbling' device (FIG. 1), fan devices (FIGS. 2 and 3), flapper or governor valve devices (FIGS. 4, 5 or 9), feed back devices (FIG. 6) and other electrically controlled or motorised devices.

27 Claims, 7 Drawing Sheets

GAS APPLIANCES

This invention relates to improvements in or relating to gas appliances and more particularly to gas burners or gas fires.

Gas burners or fires are well known which produce a decorative or flame effect which attempt to mimic flames from a real log or coal fire. The general aim of such mimicking effects is to try to achieve the most realistic natural flame effect simulating a coal or log fire but such attempts to produce such flames may be limited or such flames may not be as realistic as could be the case.

An object of the present invention is to provide a gas appliance such as a gas burner or a gas fire having a more realistic flame effect or a flame effect which is improved or different in one or more respects.

According to the present invention there is provided a gas appliance such as a gas burner or gas fire having means to vary the factors producing flame or flames in the appliance in a substantially random manner.

Further according to the present invention there is provided a gas appliance such as a gas burner or fire having means to vary the factors which characterise a particular flame or flames of the appliance whilst the appliance is turned to a particular setting, said means varying said characteristics and being for example means to vary the amount of gas being input to the appliance whilst on a particular setting, preferably, in a random, substantially random or pseudo-random, pre-set or pre-programmed manner.

There are many ways of producing the required randomising of e.g. the gas flow or pre-set program or variation e.g. of gas flow in order to produce a living flame effect and this specification details a number of ways this can be achieved. Overall, possibly the preferred way is to have an electronic randomising device coupled to a motor unit, the speed of the motor varying in a random way in accordance with the electronic randomising unit. In one embodiment, the motor may be connected to an axially reciprocable spindle that could be used in any number of a variety of situations to control gas flow (or air or air/gas flow or pressure), either by controlling a valve or by acting in or by an orifice or hole to vary the amount by which the orifice or hole is opened or closed in a random way, thereby effecting the amount of gas flow through the hole or the orifice.

The randomising device can include a container housing a fluid or liquid through which gas or a mixture of air and gas or air is introduced or bubbled through.

The randomising device can comprise or include a radial or axial fan unit possibly having different angularly spaced fan blade means and/or different aperture means in the fan blade means.

The randomising device may comprise or include a flapper valve.

The randomising device may comprise or include an unstable governor control or an oscillating vapour pressure fluid interface or a fluid oscillator which may be time controlled.

It is also possible that a pre-set program cycle of gas flow control or other control of the factors which produce a flame in the appliance may be provided by dedicated computer software formulated to yield seemingly the most effective or at least a much more effective decorative living flame effect.

Many advantageous features of the present invention will be apparent from the following description and drawings.

Embodiments of the present invention will now be described by way of example only with reference to the FIGURES of the accompanying drawings in which.

Figure 2:
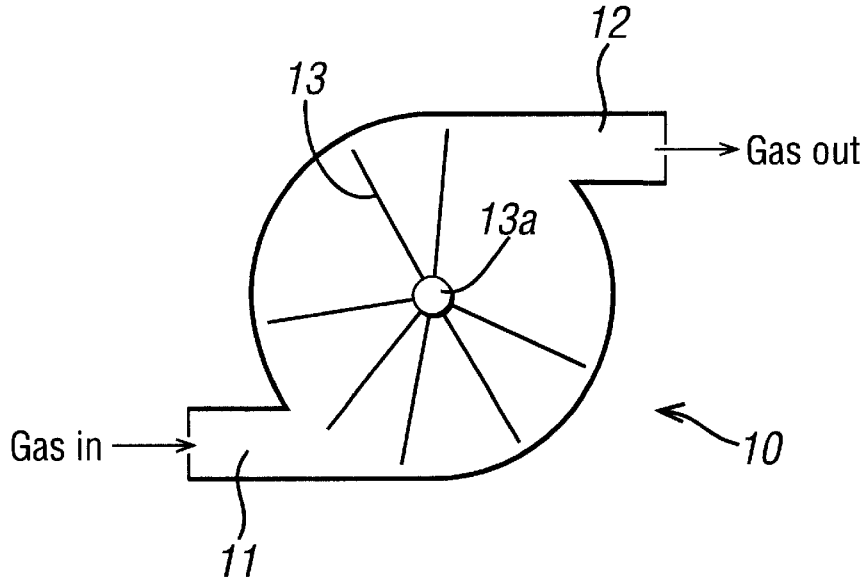
FIG. 2 shows a second embodiment of a device for randomising gas flow to a burner in the form of a variable flow fan.
Figure 3A:
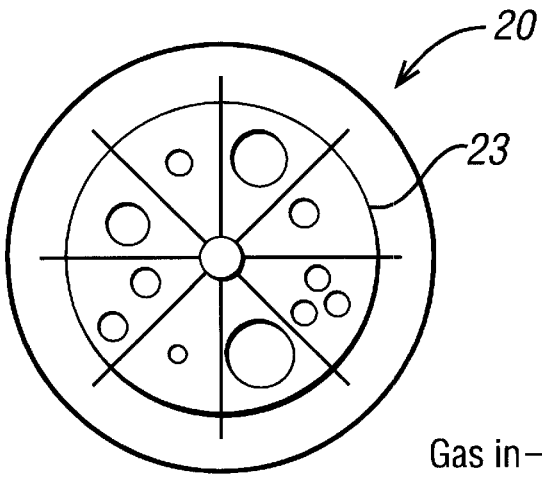
Figure 3B:
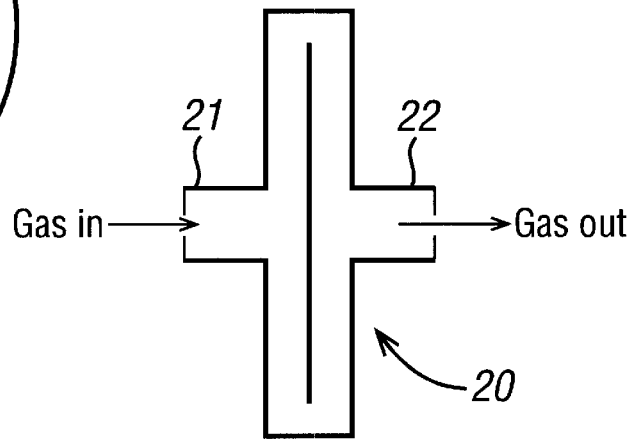
Figure 4A:
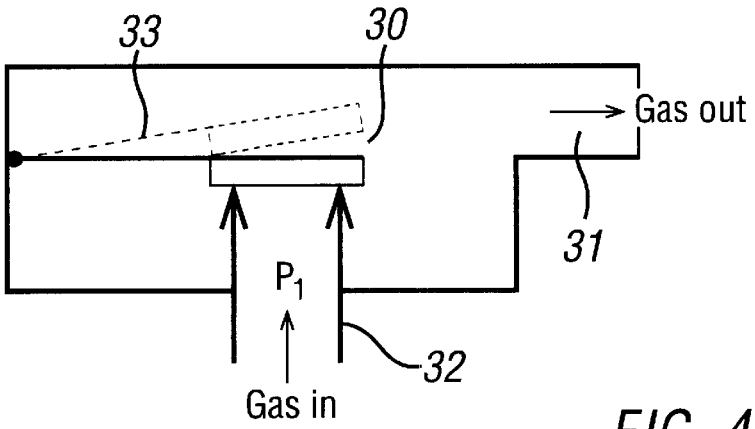
Figure 4B:
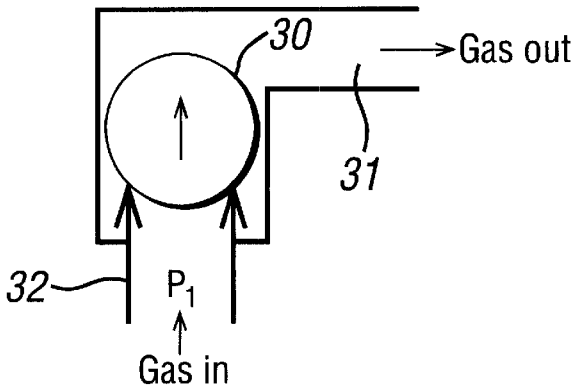
Figure 5:
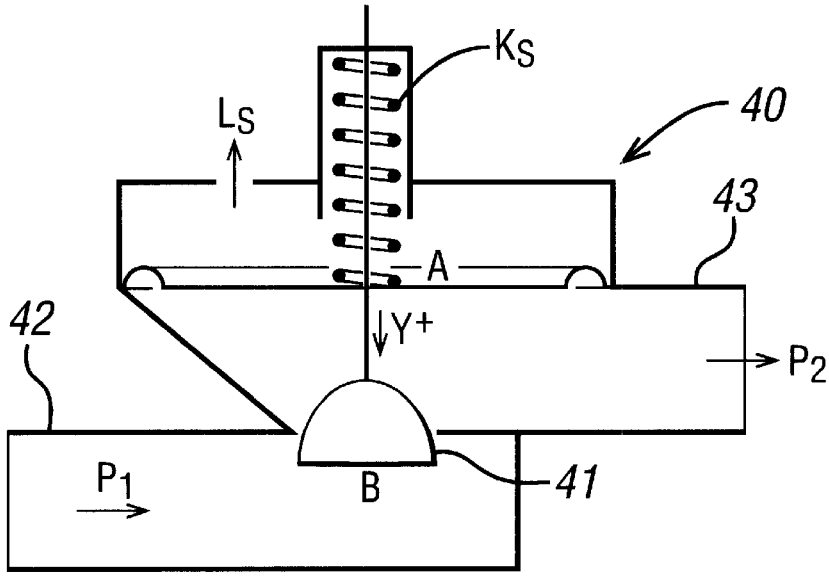
Figure 6:
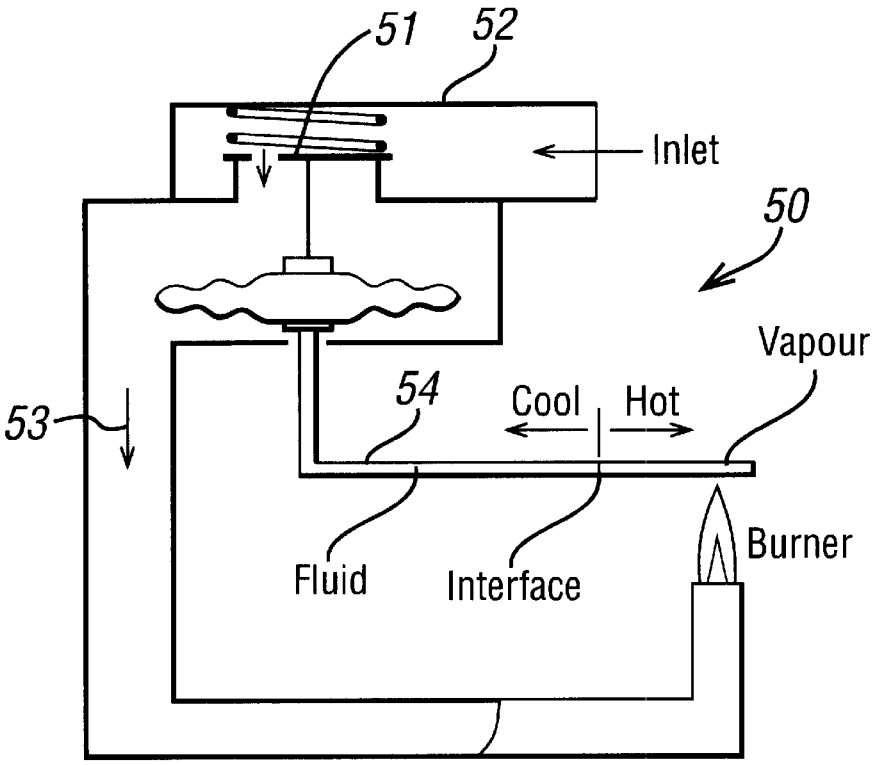
Figure 7:
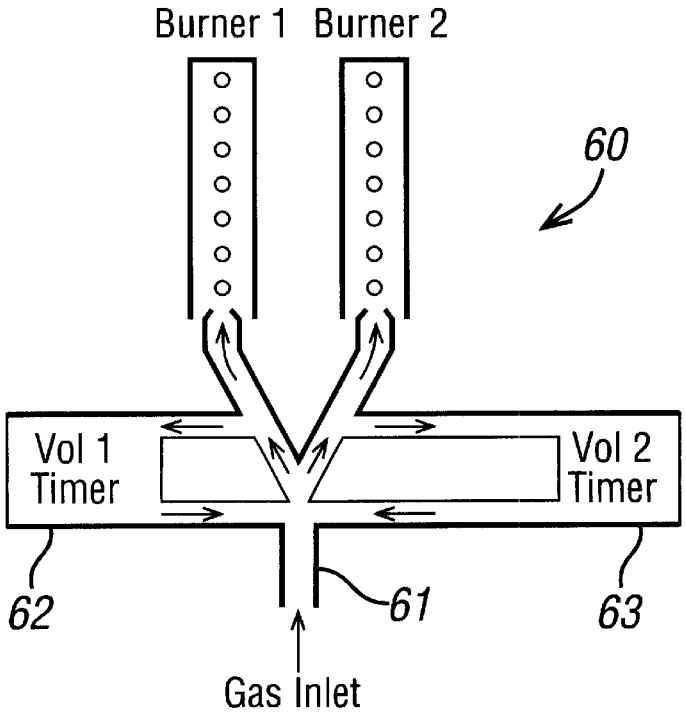
Figure 8:
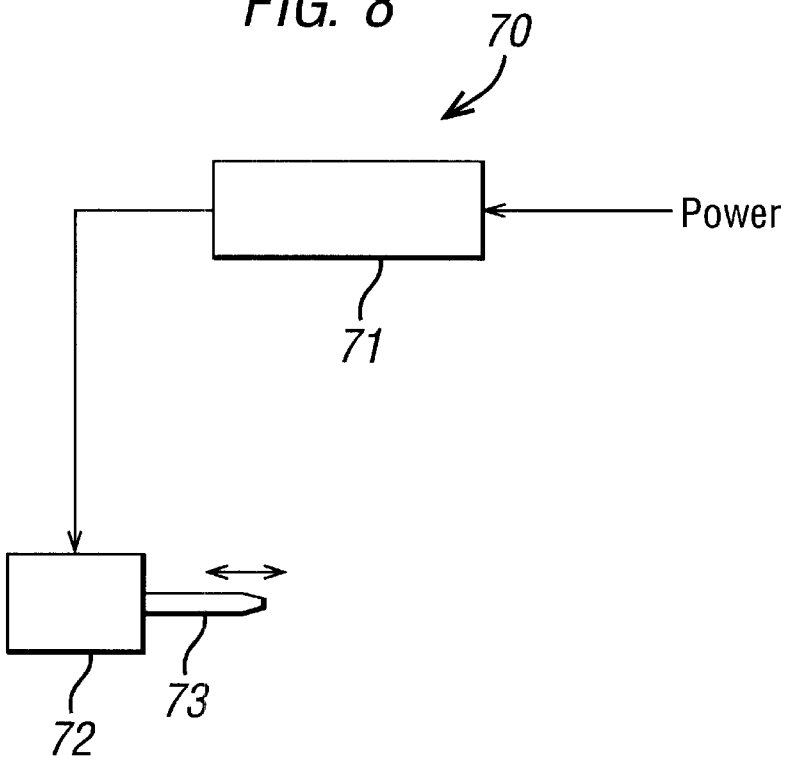
Figure 9:
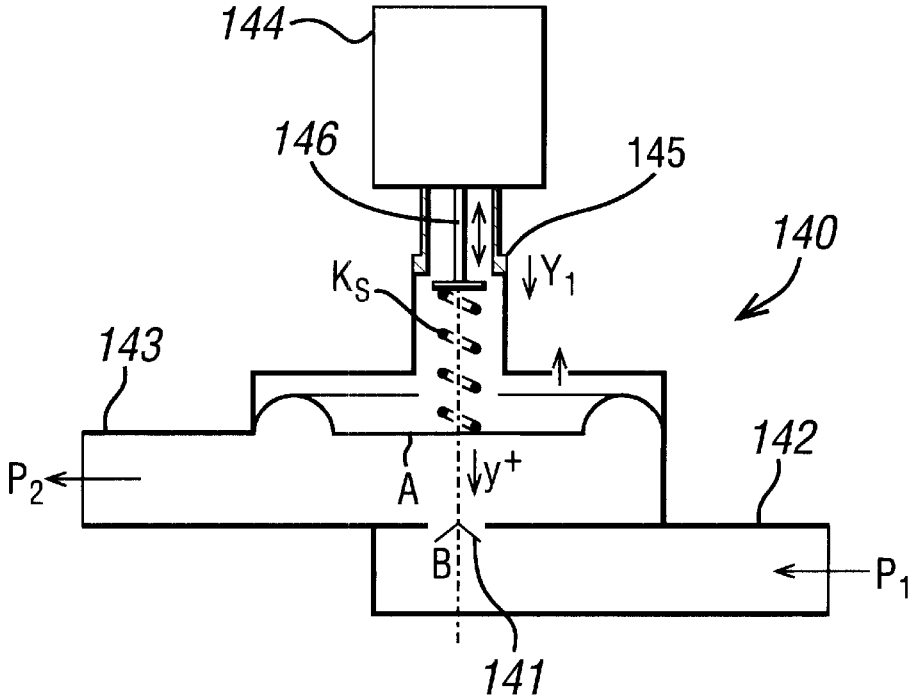
Figure 10:
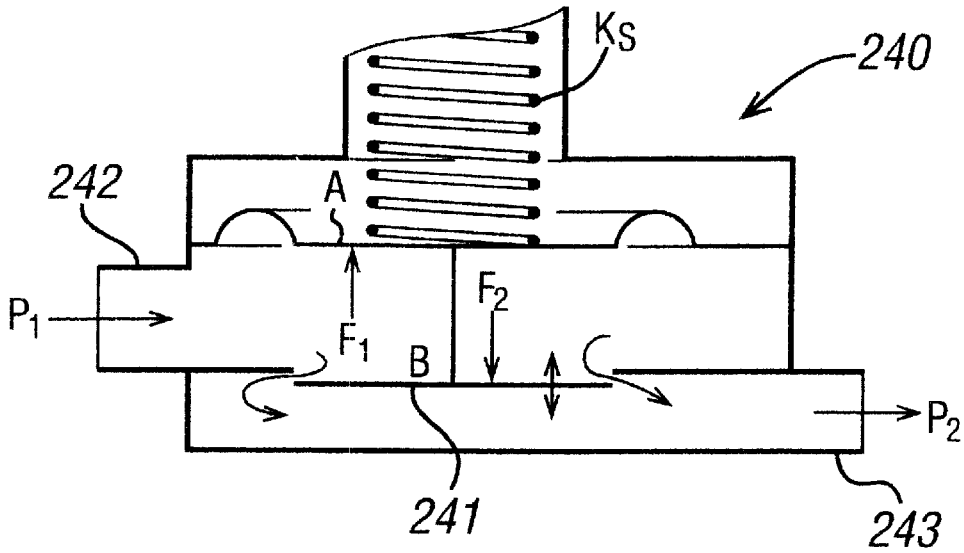
Figure 11:
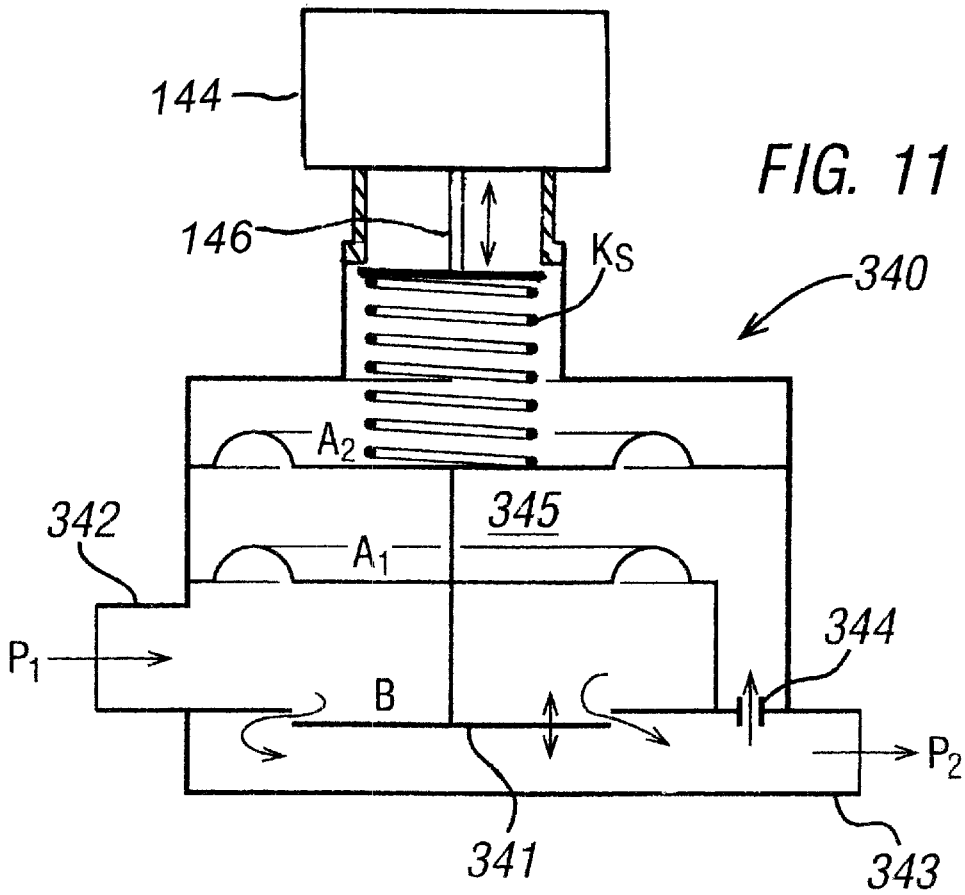
Figure 12:
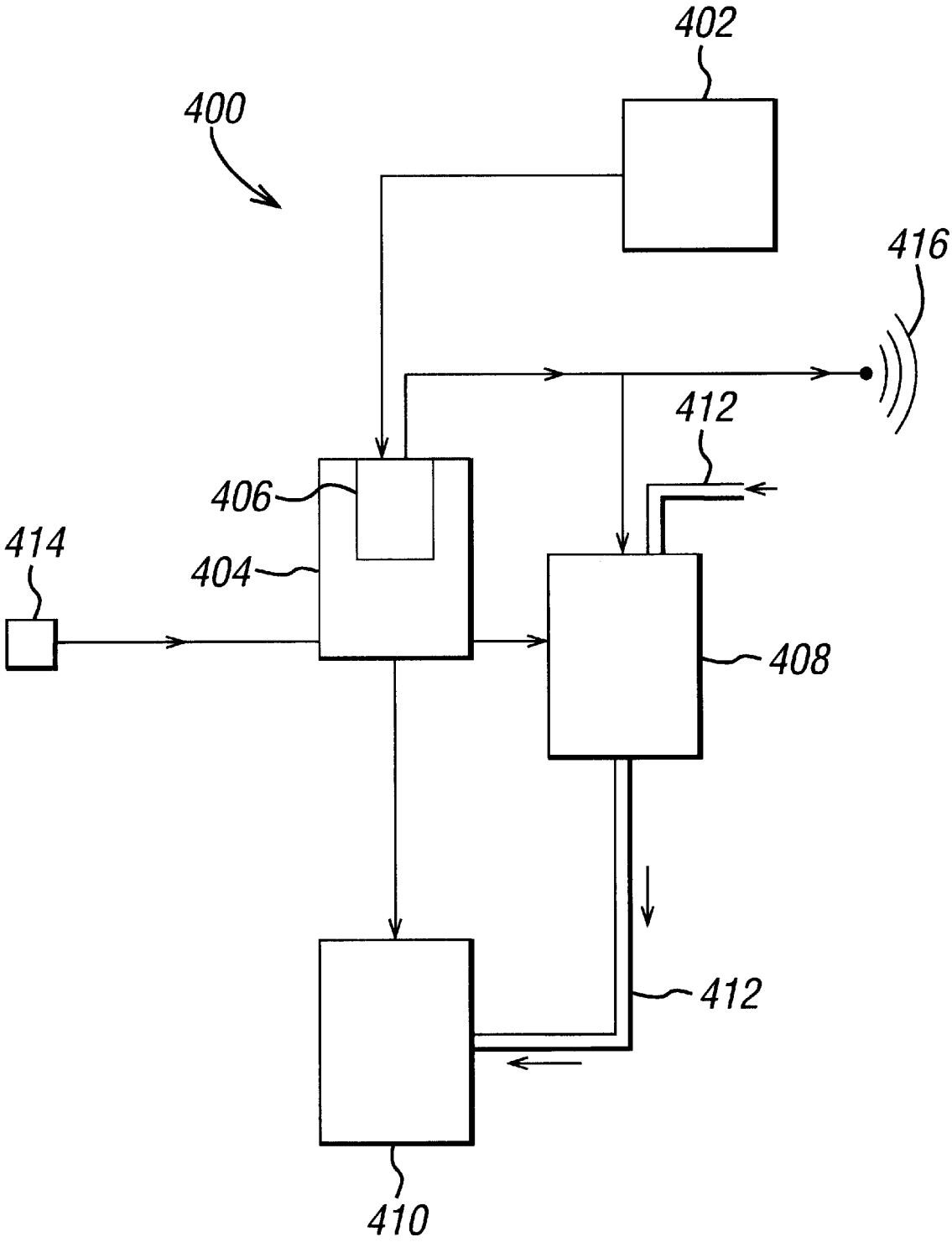

FIGS. 3*a* and 3*b* show a variation of the arrangement shown in FIG. 2;

FIGS. 4*a* and 4*b* show a third form of randomising device for varying the gas pressure in the form of a flapper valve;

FIG. 5 shows another form of randomising device in the form of an unstable governor;

FIG. 5(*a*) is a graph schematically showing the behaviour of the governor device shown in FIG. 5;

FIG. 6 shows another form of randomising device;

FIGS. 7–9 show further randomising devices;

FIGS. 10 and 11 show yet further randomising mechanisms using governor devices; and FIG. 12 shows schematically a gas appliance in accordance with the invention.

Figure 1:
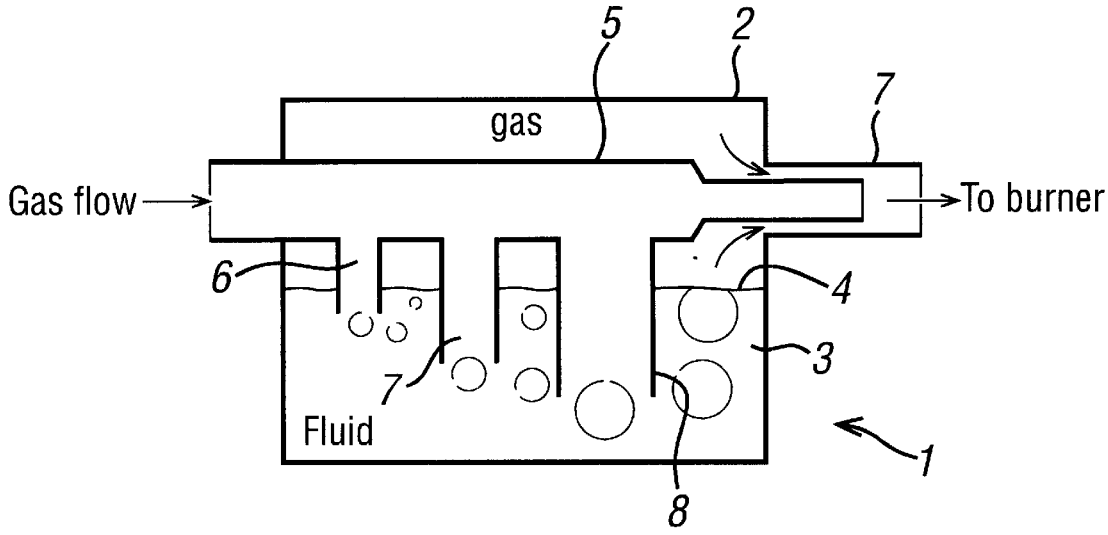
FIG. 1 shows a first embodiment of a device for randomising gas flow to a burner in the form of a fluid container.

FIG. 1 shows a first embodiment of a randomising device 1 that could be utilised to provide a random gas flow to a burner or the like, on a particular setting which has been manually selected by the user. The randomising device 1 includes a container 2 housing a suitable fluid or liquid 3 up to the level 4 as shown in the FIGURE. A gas pipe 5 has downwardly depending sequentially arranged tubular outlets at different lengths 6, 7 and 8 extending into the fluid and gas is contained in the container 2 above the liquid (after being bubbled through fluid 3) which can pass out of the container via outlet 9 as shown in the drawings. Thus, in use, the gas flow input through pipe 5 can be bubbled through the fluid 3 before passing out of the exit port 9 with gas also being fed into pipe 5 and out through the port 9 in a manner without passing into container 2 which should be self-evident from the drawings. In this way, passing the gas through a fluid can cause a bubbling effect giving a generally random or pseudo-random flow via the concentric tube outlet arrangement 9 in a manner which should be self-explanatory.

It is desired to produce a random or generally pseudo-random gas flow to the burner when a particular manual setting has been selected by the user in order to provide a random or pseudo-random variation in the flame effect produced at the burner to give a more realistic flame effect.

Such a bubbler could be utilised with the input of gas and/or air and/or gas air mixture in order to produce such an effect.

FIG. 2 shows another embodiment of a gas flow randomiser 10 which is in the form of a variable radial flow fan unit having a gas inlet 11 and a gas outlet 12, said variable flow fan including an internal fan blade or vane configuration 13 which is rotatable about the axis 13*a* and which has a selected number of variably angled spaced vanes as will be evident from FIG. 2 of the drawings.

Rather than providing a randomising or pseudo-randomising effect to the gas flowing out of port 12 using a radial vane arrangement as shown in FIG. 2 it is also be possible to employ an axial flow fan unit 20 as shown in FIG. 3. FIG. 3 shows an axial view of the fan unit 20 of the left and a diametrical sectional view of the fan unit on the right, the gas flow is axial through the fan unit, in entrance port 21 and out exit port 22 in a manner which should be generally self-explanatory. As the fan blade unit 23 rotates owing to the differently sized holes provided in the vanes a generally randomising as flow effect can be produced.

FIG. 4 shows a side view of a valve above a plan view of the valve 30. Valve 30 is positioned in a gas flow passageway 31 and gas flows into the passageway 31 via the spring loaded valve 30 covering the entrance pipe 32. Thus, the pressure of the gas input in pipe 32 would build up and eventually lift the flapper valve against the spring means 33 and gas would be input into the passageway 31 up until gravity returns the valve member 30 onto its valve seat on top of pipe 32. Thus, in this way a variable random-like gas flow effect could be obtained.

FIG. 5 shows another gas flow randomising arrangement 40 having an unstable governor control 41. The various parts labelled A, B, P1, P2, M, λs, Ks, Y and Ls are identified as follows:

A=Diaphragm Area

B=Valve Area

P1=Inlet Pressure

P2=Outlet Pressure

M=Mass of Moving Parts

C=Viscous Damping Coefficient

Ks=Spring Rate

Y=Valve Movement $L_s$=spring load applied to the diaphragm.

It will be evident from FIG. 5 of the drawings that gas at a certain pressure P1 enters passageway 42 and flows past the governor valve B into a second part 43 of the passageway at pressure P2.

The equation of motion for the spring loaded governor can be approximated by a second order differential equation namely.

$$\left(D^2 + \frac{C}{M}D + \frac{K}{M}\right) Y = I,$$

where D is the D operator $$\frac{d}{dt}$$

and;

$$I = \frac{-P_2(A-B) - P_1 B}{M}$$

When the roots of the characteristic equation are complex conjugates, C/M can be identified with $2\zeta\omega_n$ and K/M with $\omega_n^2$, where $\zeta$ is the damping ratio and $\omega_n$ the natural frequency.

Figure 5A:
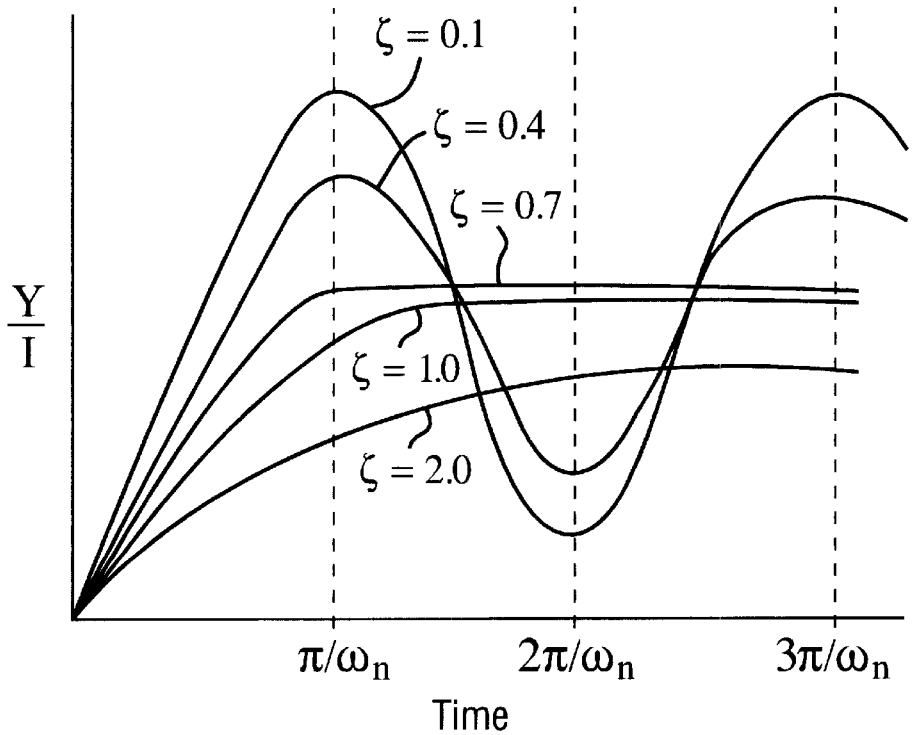

FIG. 5*a* shows typical responses of I/Y for various values of $\zeta$.

Thus the governor can be made unstable by decreasing the damping ratio $\zeta$, that is by decreasing the viscous effects, for example by increasing the breather hole in the chamber above the diaphragm, i.e. reducing the damping effect of the air within the chamber.

If the option is required to give stable conditions i.e. a steady flame pattern, a shutter operated by the user of the appliance can be provided, which can be used to close off part of the breather hole, say if it was desired to initially heat the room without the dancing flame effect, and then opening up the shelter to increase the breather hole and give the dancing flame effect.

FIG. 6 shows yet another arrangement 50 for randomising gas flow to a gas appliance, for example a burner, and as should be evident from the FIGURE there is a gas inlet port a spring loaded valve 51 with a bypass and an oscillating vapour pressure fluid interface. As shown, gas passing into the inlet 5 can bypass the valve in the direction of arrows 52 and 53 to the burner but fluid in pipeway 54 can be expanded in variable way to act on the valve 51 with more gas being turned to vapour the hotter the flame, the vapour fluid interface in the passageway 54 moving to the left or right depending upon how cool or hot the passageway is. The hotter the passageway, the more vapour pressure and the fluid is forced to the left enough to open the valve 51 in a manner which should be self-evident. Hence a feed back mechanism is provided between the burner flame and the arrangement 50 to vary the flow of gas to the burner.

FIG. 7 shows a further gas flow round the device 60 which is a fluid oscillator for a duplex burner with gas being input to the inlet 61 and to the burners 62 and 63 in a manner which should be evident from the arrows. Timers 62 and 63 are provided to randomise time taken for the gas flow to flow through for each burner.

FIG. 8 shows a further arrangement 70 for randomising gas flow consisting of an electronic randomising unit 71 connected to a suitable power supply source which is in turn connected to a motor unit 72 having a longitudinally reciprocating tapered spindle 73 able to move in and out of the motor housing in a random way controlled by the electronic randomising unit 71. It should be evident that the random reciprocating pulsating movement of the spindle 73 could be used in any number of a variety of ways to control the flow of gas to a burner or other appliance, for example by opening and closing a valve in a random way or even utilising the taper of the spindle in a surrounding hole (or by it) to vary the gap between the spindle and the hole in a random way allowing different amounts of gas to flow through the hole around the spindle in a manner which should be evident.

Referring to FIG. 9, yet another arrangement for randomising and/or varying gas flow is shown. In many respects this arrangement is similar to the arrangement shown in FIG. 5, and like components are shown in FIG. 9 labelled using the same letters, or same reference numerals prefixed by the numeral 1. Thus, a gas flow randomising arrangement 140 for a gas appliance 148 is shown having a stable valve closure governor control 141 comprising a valve having an area B. As in FIG. 5, gas enters passageway 142 at a certain pressure $P_1$, flows past the governor valve closure B and leaves a second part 143 of the passageway at a different pressure $P_2$. As the valve closure 141 having effective cross sectional area B is connected to the diaphragm having a cross sectional area A. Under stable quilibrium conditions, the following equations apply.

$$L_5 + P_2 B = P_1 B + P_2 A$$

Rearranging this we have $$P_2 = \frac{L_5 - P_1 B}{A - B}$$

Simplifying for small B:

$P_2 = L_5$

A–B and $P_2$ is approximately proportional to $L_5$

As can be seen from the stable equilibrium equations the outlet pressure P2 from the governor is highly influenced by the value of the spring load $L_s$, applied to the diaphragm. The arrangement shown in FIG. 9 allows the spring load $L_s$, and hence the outlet pressure from the governor to be varied by use of a driving means 144, that controls the position and/or movement of a plate 145 via a spindle 146. The driving (or positioning) means 144 can be in several forms, for example it may be a positional driver, stepper motor, proportional solenoid, linear motor, or any other type of electro mechanical device that produces a variable displacement as its output.

The driving means 144 and valve closure 141 can be used in several different ways to produce a flame effect that is, or appears to be substantially random. The driving means 144 can be controlled electronically to alter the position of plate 145 and the effective spring load of the governor in a random or pseudo random manner, i.e. a random or pseudo random signal can be applied to the driving means 144 so producing a random or pseudo random displacement against the spring. Alternatively, the driving means 144 can be controlled by a pre-set or pre programmed electrical signal that merely gives the impression of randomness, for example, by using an electrical signal that varies in an irregular way over a long time period so that repetitions of the signal are not noticeable to the observer.

An alternative embodiment of arrangement 140 is to attach the spindle 146 directly to the valve closure 141. This allows driving means 144 to drive the valve closure 141 directly, in a similar way to the valve arrangement already shown schematically in FIG. 8. However, the applicants have found that the arrangement shown in FIG. 9 is particularly advantageous This is because, from a control point of view, it is beneficial that driving means 144 moves spindle 146 over a relatively large distance, for example a few centimeters, whereas it is advantageous that governor valve closure 141 moves over smaller distance. e.g. perhaps a few millimeters, to allow fine control of the gas flow between passages 142 and 143. In the arrangement of FIG. 9, the presence of a spring serves to attenuate or damp the movement of the spindle so that relatively large spindle movements are translated into small movements at the governor, as desired In addition, the resilience of the spring and the resilience of the diaphragm introduce further uncertainty into the system due to the mechanical hysteresis of these two interacting elements.

Finally, turning to FIGS. 10 and 11, two further arrangements using a governor device to randomise a gas supply to a burner are shown. In the first of these (FIG. 10), the effective area of the diaphragm and the governor valve closure area are substantially the same, and in the second of these arrangements (FIG. 11) an extra, outer diaphragm is incorporated into the design, this outer diaphragm being in communication with the pressure outlet via an aperture.

FIG. 10 shows a governor arrangement with two key modifications over the arrangements already described with respect to FIGS. 5 and 9. In this case like components with those shown in FIG. 5 are labelled using the same letters. or same reference numerals prefixed by the numeral 2. The device of FIG. 10 differs from the earlier governor arrangements in that the incoming gas pressure, $P_1$acts downwardly on the valve closure governor control 241 of area B. Also, in this case the area B of the valve closure 241 and the diaphragm A are set to be substantially equal to each other. Thus, valve area B and diaphragm area A each present the same surface area to incoming pressure $P_1$, and this serves to equalise the upward pressure force $F_1$ on the diaphragm with the downward pressure force $F_2$ on the valve closure of area B. Hence, the upward and downward forces are balanced and as a consequence the outlet pressure $P_2$ may be independent of the inlet pressure $P_1$, and only dependent on the spring constant, $K_S$ and the area of the diaphragm, A.

To summarise the operation of the arrangement in FIG. 10 mathematically, the upward force s on the diaphragm and the downward forces on the valve closure can be equated as follows:

$$L_S+P_1B=P_2B+P_1A$$

But as A=B, therefore:

$$L_S+P_1A=P_2A+P_1A$$

So that, $$L_S=P_2A$$

and:

$$P_2=\frac{L_s}{A}$$

and $$P_2 \propto L_2$$

The arrangement of FIG. 10 is advantageous as it simplifies the governor design. However, it may not be practical in all cases to increase the area of the valve closure B to that of the area of the diaphragm A as it may make the governor hard to control because very small movements of the closure B can cause large changes in the rate of gas flow between passages 242 and 243.

Turning to FIG. 11, a yet further modification of the governor device is shown. Again, like components are shown using the same reference numerals as before, but this time prefixed by the number 3 The arrangement of FIG. 11 has essentially two modifications: a further diaphragm is added, so that there are now two diaphragms, A1 and A2, and an aperture 344 is provided between the gas outlet passage 343 and the volume between the two diaphragms, denoted by 345. Thus, in this case, the pressure in the volume 345 is substantially the same as the pressure $P_2$ in the passage 343. If the area of the valve closure B is set to be substantially the same as the area of the lower diaphragm A1, and the upward and downward forces are resolved as before, the following relationship is found to hold:

$$L_s+P_2A_1+P_1B=P_2B+P_1A_1+P_2A_2$$

If $A_1$=B, we therefore have:

$$P_2=\frac{L_s}{A_2}$$

and again $$P_2 \propto L_s$$

FIG. 12 shows a gas appliance in accordance with the invention in schematic form. The appliance 400 comprises a user control 402, an appliance control 404 incorporating a flame effect control 406, a flame effect mechanism 408 and a gas fire 410. FIG. 12 illustrates the command chain from the user controller 402, via the flame effect 406 and fire control 404 to the flame effect mechanism 408 and fire 410 respectively. The user control 402 may comprise a control panel on the fire or mounted in the wall. Alternatively, the user control may comprise a remote control such as an infrared remote control. The user controller 402 includes controls for switching the fire on and off, for varying the intensity and/or size of the fire and means for effecting the realistic flame effect.

The commands entered by the user on the user control 402 are passed to the fire control 404 and the flame effect control 406 as appropriate. The fire control 404 can then operate the fire 410 in a manner selected by the user. Where the user selects the realistic flame effect, the flame effect control 406 passes a signal to the flame effect mechanism 408 to effect the randomisation in gas flow to the fire 410. The gas supply is shown at 412. The control 404 and 406 are preferably electronic controls, most preferably PCB's having operating CPU's. The system shown is most preferably used with one of the randomising devices of FIGS. 9–11. In that way, the flame effect control passes variable, pseudo random signals to the driving means 144 of the flame effect mechanism so as to generate a randomised gas supply to the fire 410. A safety shut off valve (not shown) may be provided in the supply line 412. The safety shut off valve preferably comprises a solenoid valve which can be effected to shut off gas supply to the fire 410. Most preferably, the safety shut off valve and the flame effect mechanism are incorporated in the single housing. The fire control 404 may also receive signal data from a thermostat and may alter the operation of the fire 410 in response to that data. In particular, once a desired temperature is reached, the fire control 404 may shut off or turn down the fire 410.

The flame effect control 406 includes a random number generator which provides the random signal to the drive means of the flame effect mechanism 408. That random number generated by the flame effect control may be routed through a loudspeaker. Such a random number generation when passed as a signal through a loudspeaker will result in a crackling noise which simulates the noise of a genuine coal or wood fire.

It is to be understood that the scope of the present invention is not to be unduly limited by the particular choice of terminology and that a specific term may be replaced by any equivalent or generic term. For example, the term "random" could be replaced by "irregularly variable". Further it is to be understood that individual features, method or functions related to the appliance or randomising device might be individually patentably inventive.

What is claimed is:

1. A gas appliance having varying means to vary the factors producing flame or flames in the appliance in a random manner wherein the varying means comprises a gas flow passageway to direct gas to an appliance burner, and a movable body located in the passageway, and wherein a driving means operably acts on the movable body and variation in pressure in the passageway causes the body to move in an unstable manner in the passageway, so randomizing the flow of gas to the appliance burner.

2. A gas appliance according to claim 1 wherein movement of the driving means is transmitted to the movable body and/or diaphragm by a resilient member.

3. A gas appliance according to claim 1 wherein the driving means is a positional driver, stepper motor, proportional solenoid or linear motor.

4. A gas appliance according to claim 3 where the movement of the driving means is controlled electronically to move randomly or pseudo randomly by the application of a random or pseudo random electronic signal.

5. A gas appliance according to claim 3 where the movement of the driving means is controlled by an electronic signal that is varied by the gas appliance user.

6. A gas appliance according to claim 1 comprising a plurality of diaphragms.

7. A gas appliance having varying means to vary the factors producing flame or flames in the appliance in a random manner wherein the varying means comprises a gas flow passageway to direct gas to an appliance burner and a movable body located in the passageway, a portion of the passageway downstream from the movable body comprises a volume enclosed by a movable diaphragm member, and wherein a driving means operably acts on the diaphragm and variation in pressure in the passageway causes the body to move in an unstable manner in the passageway, so randomizing the flow of gas to the appliance burner.

8. A gas appliance having varying means to vary the factors which characterize a flame of the appliance, whilst the appliance is on a particular setting, wherein the varying means varies the supply of gas in a random manner, the varying means comprising:

a gas flow passageway with first and second portions, an aperture connecting the first and second portions, and a moveable body located in the passageway moveable relative to the aperture to alter the rate of gas flow through the aperture, and the moveable body attached to a diaphragm acted upon by a resilient member, wherein the diaphragm moves under the influence both of gas flow through the passageway and the influence of the resilient member, and driving means operable to act upon the resilient member.

9. A gas appliance according claim 8 wherein movement of the driving means is transmitted to the movable body and/or diaphragm by the resilient member.

10. A gas appliance according to claim 8 wherein the resilient member is a spring.

11. A gas appliance according to claim 8 wherein the diaphragm moves under the influence of the resilient member in use.

12. A gas appliance according to claim 8 wherein a driving means operably acts on the diaphragm.

13. A gas appliance according to claim 8 wherein the driving means is a positional driver, stepper motor, proportional solenoid or linear motor.

14. A gas appliance according to claim 8 wherein the movement of the driving means is controlled by an electrical signal that is varied by the gas appliance user.

15. A gas appliance according to claim 8 wherein the movement of the driving means is controlled electronically to move randomly or pseudo randomly by the application of a random or pseudo random electronic signal.

16. A gas appliance according to claim 15 wherein the area that the movable body presents to the gas flow is substantially the same as the area that the diaphragm presents to the gas flow.

17. A gas appliance according to claim 8 comprising first and second diaphragms and wherein the first and second diaphragms are connected to move substantially in phase with each other.

18. A gas appliance according to claim 17 wherein a volume enclosed by a second diaphragm is in fluid communication with a portion of the gas flow passageway downstream from the movable body.

19. A gas appliance according to claim 8 wherein the varying means varies the factors or supply of gas in a pseudo-random manner.

20. A gas appliance according to claim 8 wherein the varying means varies the factors or supply of gas in a pre-set manner.

21. A gas appliance according to claim 8 wherein the varying means varies the factors or supply of gas in a pre-programmed manner.

22. A gas appliance according to claim 8 wherein the varying means varies gas flow to a burner in the appliance.

23. A gas appliance according to claim 8 wherein the resilient member serves to force the diaphragm toward the centre of the passageway.

24. A gas appliance having varying means to vary the factors which characterize a flame of the appliance, whilst the appliance is on a particular setting, wherein the varying means varies the supply of gas in a random manner and the varying means varies the factors or supply of gas in a random manner, the varying means comprising:

a gas flow passageway with first and second portions, an aperture connecting the first and second portions, and a moveable body located in the passageway moveable relative to the aperture to alter the rate of gas flow through the aperture, and the moveable body attached to a diaphragm acted upon by a resilient member, wherein the diaphragm moves under the influence both of gas flow through the passageway and the influence of the resilient member, and driving means operable to act upon the resilient member.

25. A gas appliance having varying means to vary the factors producing flame or flames in the appliance in a random manner wherein the varying means comprises a gas flow passageway to direct gas to an appliance burner, and a movable body located in the passageway, and wherein the means varies the factors or supply of gas in a pseudo-random manner and variation in pressure in the passageway causes the body to move in an unstable manner in the passageway, so randomizing the flow of gas to the appliance burner.

26. A gas appliance having varying means to vary the factors producing flame or flames in the appliance in a random manner wherein the varying means comprises a gas flow passageway to direct gas to an appliance burner, and a movable body located in the passageway, and wherein the means varies the factors or supply of gas in a pre-set manner and variation in pressure in the passageway causes the body to move in an unstable manner in the passageway, so randomizing the flow of gas to the appliance burner.

27. A gas appliance having varying means to vary the factors producing flame or flames in the appliance in a random manner wherein the varying means comprises a gas flow passageway to direct gas to an appliance burner, and a movable body located in the passageway, and wherein the means varies the factors or supply of gas in a pre-programmed manner and variation in pressure in the passageway causes the body to move in an unstable manner in the passageway, so randomizing the flow of gas to the appliance burner.

* * * * *